US011832749B2

(12) United States Patent
Tartal et al.

(10) Patent No.: US 11,832,749 B2
(45) Date of Patent: Dec. 5, 2023

(54) CHUTE LOCKOUT DEVICE AND METHODS

(71) Applicant: United States Postal Service, Washington, DC (US)

(72) Inventors: William Albert Tartal, Baltimore, MD (US); Joram Shenhar, Fairfax, VA (US); Joel Locknauth Dewnandan, Bladensburg, MD (US)

(73) Assignee: United States Postal Service, Washington, DC (US)

( * ) Notice: Subject to any disclaimer, the term of this patent is extended or adjusted under 35 U.S.C. 154(b) by 176 days.

(21) Appl. No.: 17/449,422

(22) Filed: Sep. 29, 2021

(65) Prior Publication Data

US 2022/0095822 A1 Mar. 31, 2022

Related U.S. Application Data

(60) Provisional application No. 63/085,048, filed on Sep. 29, 2020.

(51) Int. Cl.
*A47G 29/126* (2006.01)
*A47G 29/12* (2006.01)

(52) U.S. Cl.
CPC ..... *A47G 29/126* (2013.01); *A47G 29/1207* (2013.01)

(58) Field of Classification Search
CPC ..... A47G 29/126; A47G 29/1207; A47G 29/124; A47G 29/30; A47G 29/122; A47G 29/1245; A47G 29/20; H01R 13/6397
See application file for complete search history.

(56) References Cited

U.S. PATENT DOCUMENTS 158,230 A * 12/1874 Avey ..... A47G 29/126 232/46
231,031 A * 8/1880 Free ..... A47G 29/126 232/46
584,459 A * 6/1897 Chaney ..... A47G 29/126 49/171
659,486 A * 10/1900 Mulloy ..... A47G 29/1207 232/47
1,032,304 A * 7/1912 Seymour ..... A47G 29/126 232/45
1,794,069 A * 2/1931 Foss ..... A47G 29/126 49/67
1,824,881 A * 9/1931 Foss ..... A47G 29/126 232/19
1,846,762 A * 2/1932 Scantlebury ..... E05G 7/002 49/463

(Continued)

*Primary Examiner* — William L Miller
(74) *Attorney, Agent, or Firm* — Knobbe, Martens, Olson & Bear LLP

(57) ABSTRACT

A lockout device for an opening of a collection box, such as a postal collection box. The lockout device can include a cover sized to block the opening to prevent access to the contents of the collection box through the opening. In one example, the cover can be assembled over the opening and a locking pin can be inserted through apertures in the lateral sides of the opening walls and lateral sides of the cover. The locking pin can be lock in place using a lock and lock guard. In another example, the cover includes an internal extension assembly with clamping mechanisms that can engage with the lateral sides of the opening.

20 Claims, 16 Drawing Sheets

(56) References Cited

U.S. PATENT DOCUMENTS

| | | | | |
|---|---|---|---|---|
| 1,983,071 | A * | 12/1934 | Cutler | A47G 29/1245 232/45 |
| 3,134,146 | A * | 5/1964 | Geoghegan | A47G 29/1245 49/463 |
| 6,343,737 | B1 * | 2/2002 | Adams | E05C 19/18 232/19 |
| 2006/0273146 | A1 * | 12/2006 | Roddy | A47G 29/126 232/19 |
| 2010/0294007 | A1 * | 11/2010 | Cyphers | A47G 29/124 70/141 |
| 2015/0359372 | A1 * | 12/2015 | Cho | A47G 29/1245 232/18 |
| 2016/0206125 | A1 * | 7/2016 | Cobb | A47G 29/126 |
| 2017/0054252 | A1 * | 2/2017 | Gates | H01R 13/6397 |
| 2021/0103725 | A1 * | 4/2021 | Tartal | G06V 10/12 |
| 2022/0095823 | A1 * | 3/2022 | Cobb | A47G 29/126 |

* cited by examiner

CHUTE LOCKOUT DEVICE AND METHODS

CROSS-REFERENCE TO RELATED APPLICATIONS

This application claims the benefit of U.S. Provisional Application Ser. No. 63/085,048, filed Sep. 29, 2020, titled "CHUTE LOCKOUT DEVICE AND METHODS," which is incorporated by reference herein in its entirety.

FIELD

This application generally relates to systems and methods for locking an opening in an item collection chute.

BACKGROUND

Distribution networks and logistics systems can use collection boxes in various locations for receiving distribution items. These collection boxes serve as depositories for senders to deposit letters, packages, or other items that can later be picked up by the distribution network for processing. A distribution network may desire to close or lock a collection box, or to prevent a sender from depositing an item.

SUMMARY

One aspect of the disclosure is a lockout device for an opening of a collection box. The lockout device can be sized to block the opening to prevent access to the contents of the collection box through the opening. The lockout device can be removably assembled across the opening.

According to another aspect of the disclosure, the lockout devices includes a cover having first and second apertures. The cover can include a front face that block the opening, when installed therewith. The cover can be assembled over the opening either within or around one or more plates bounding the opening. The first and second apertures can be aligned with corresponding passages on the opening (e.g., on the one or more plates).

According to another aspect of the disclosure, the lockout device can further include a lockout pin insertable through the first and second apertures and the corresponding passages. A locking pin can then be locked in place using a conventional lock.

According to another aspect of the disclosure, the locking pin can be used in conjunction with a lock guard. The lock guard can be formed of a durable material such as steel. The lock guard can include a lock slot that prevents access to a shank portion of the lock on at least two sides. The lock slot in the lock guard can prevent the lock shank from being easily cut using bolt cutters or saws.

Another aspect of the disclosure is a method of forming the corresponding passages around the opening. The opening can be bounded by first and second side plates. The method can include placing the cover over the opening with first and second side members of the cover being aligned along the first and second side plates. The first and second apertures can be aligned with first and second locations on the first and second side plates. These locations can be marked. The method further includes creating the corresponding passages in the first and second side plates at the marked locations. The passages can be cut using a cutting or drilling process. In this manner, a conventional opening of a collection box can be retrofitted to be used in conjunction with the lockout device having a locking pin described herein.

Another aspect to the disclosure is a lockout device that includes a cover and further includes a clamping assembly for securing the cover within an opening. The opening can include opposite inner sides (e.g., on the first and second side plates). The clamping assembly can include a clamping linkage. The clamping linkage can include first and second extension members that are extendable and retractable relative to the opposite inner sides. In an extended configuration, the extension members can engage with the inner opposite sides to secure the cover in place within the opening. In a retracted configuration, the extension members can be disengaged from the inner opposite sides to allow removal of the lockout device.

According to another aspect, the clamp linkage can include a movable shaft for extending and retracting the extension members. The clamp linkages and the extension members can be locked in place by securing the movable shaft in place. The movable shaft can be secured by assembly of a hasp or a lock with the movable shaft.

The foregoing summary is illustrative only and is not intended to be limiting. Other aspects, features, and advantages of the systems, devices, and methods and/or other subject matter described in this application will become apparent in the teachings set forth below. The summary is provided to introduce a selection of some of the concepts of this disclosure. The summary is not intended to identify key or essential features of any subject matter described herein.

BRIEF DESCRIPTION OF THE DRAWINGS

Various examples are depicted in the accompanying drawings for illustrative purposes, and should in no way be interpreted as limiting the scope of the examples. Various features of different disclosed examples can be combined to form additional examples, which are part of this disclosure.

DETAILED DESCRIPTION

The various features and advantages of the systems, devices, and methods of the technology described herein will become more fully apparent from the following description of the examples illustrated in the figures. These examples are intended to illustrate the principles of this disclosure, and this disclosure should not be limited to merely the illustrated examples. The features of the illustrated examples can be modified, combined, removed, and/or substituted as will be apparent to those of ordinary skill in the art upon consideration of the principles disclosed herein.

Distribution networks, such as the United States Postal Service (USPS) use collection boxes or item receptacles to allow senders to deposit items for induction into the distribution network. The item receptacles can include an opening in the shape of a narrow slot or chute through which items, such as individual packages, envelopes, flats, parcels, or other items, can be inserted into the item receptacle. A distribution network may desire to close the opening of an item receptacle for a variety of reasons, for example, related to security, quality of service, etc. Further, the distribution network may desire to lock the opening shut such a party cannot access the opening or insert an item into the item receptacle. However, some types of collection boxes lack any cover for the opening or other means of closing the opening. The current disclosure describes example systems and methods for closing, locking, or otherwise securing item receptacles.

Figure 1A:
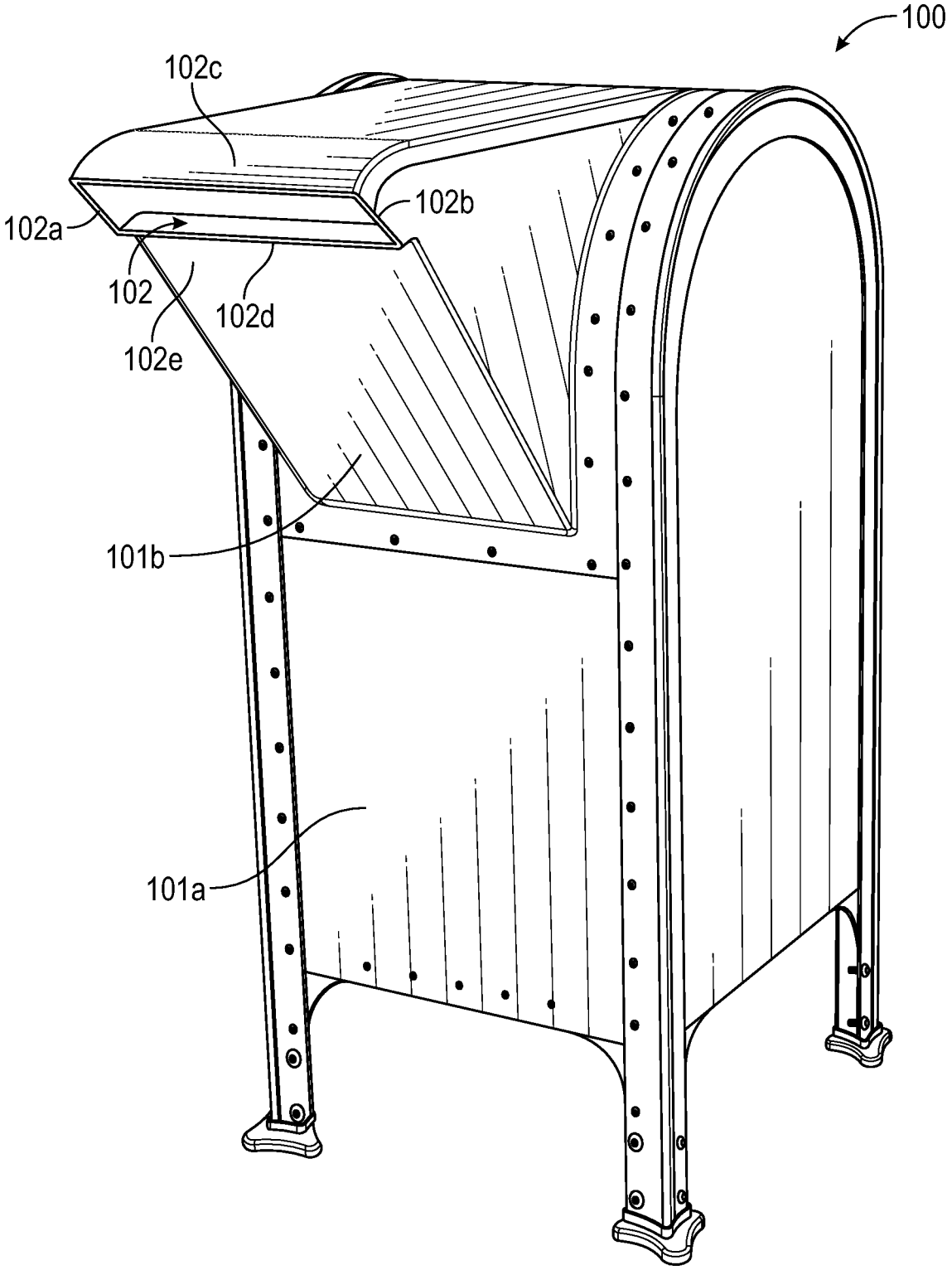
FIG. 1A shows an example item receptacle including an opening.

FIG. 1A shows an example item receptacle, a collection box 100 including an item storage area 101*a* and a chute 101*b*. The chute 101*b* has an opening 102 formed therein. The opening 102 allows items, such as mail, flats, envelopes, parcels, etc. to be inserted into the chute 101*b* and thereby drop into the item storage area 101*a* of the collection box 100. The opening 102 can be generally rectangular. The opening 102 can be bounded or partially bounded by a plurality of plates. For example, the opening 102 can be bounded by a first side plate 102*a*, a second side plate 102*b*, an upper plate 102*c*, and/or a lower plate 102*d*. The collection box 100 can further include a lower wall 102*e* on a bottom side of the chute 101*b* leading into the item storage area 101*a*.

The plurality of plates 102*a-d* can each include flat and/or curved surfaces. The plurality of side plates 102*a-b* can be formed of a metal material, such as sheet or plate steel. The upper plate 102*c* can generally be curved in a manner that orients the opening 102 generally downwardly. This can prevent the collection of precipitation through the opening 102. One or more of the plurality of plates 102*a-d* can be omitted. Particularly, the lower plate 102*d* can be optional. A lower side of the opening 102 can be contiguous with a lower wall 101*b* of the chute.

Figure 1B:
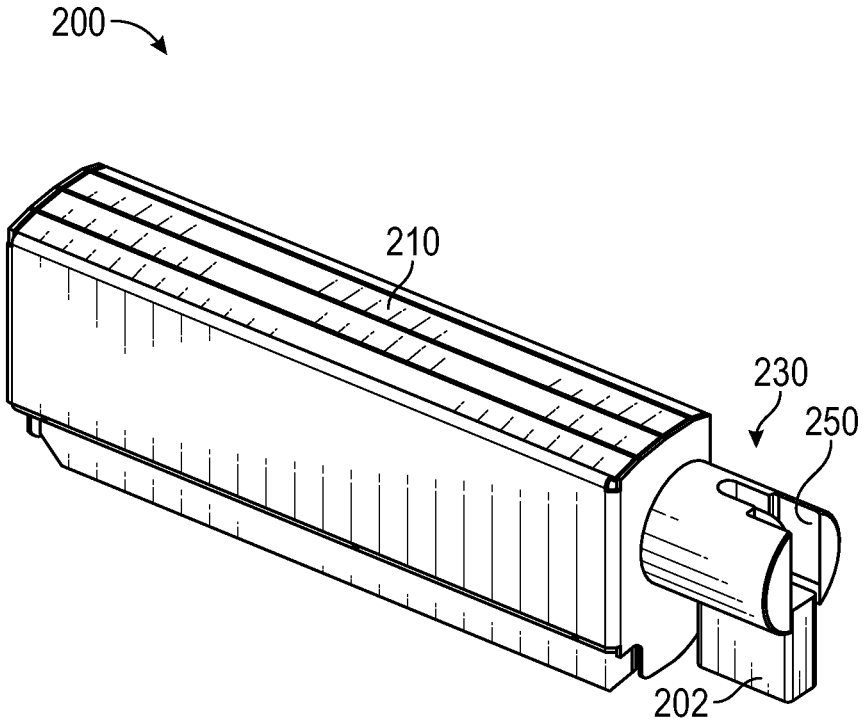
FIG. 1B shows a perspective view of an example lockout device.

FIG. 1B illustrates an example lockout device 200 usable in conjunction with the collection box 100 of FIG. 1A or with other item receptacles. When used in conjunction with the collection box 100, the lockout device 200 can be assembled over and/or at least partially within the opening 102 to block access to the contents within the item storage area 101*a* and/or to prevent any party from inserting an item or object into the collection box 100. The lockout device 200 can include a cover 210, a locking mechanism 230, and a lock guard 250 for use with a lock 202.

Figure 2:
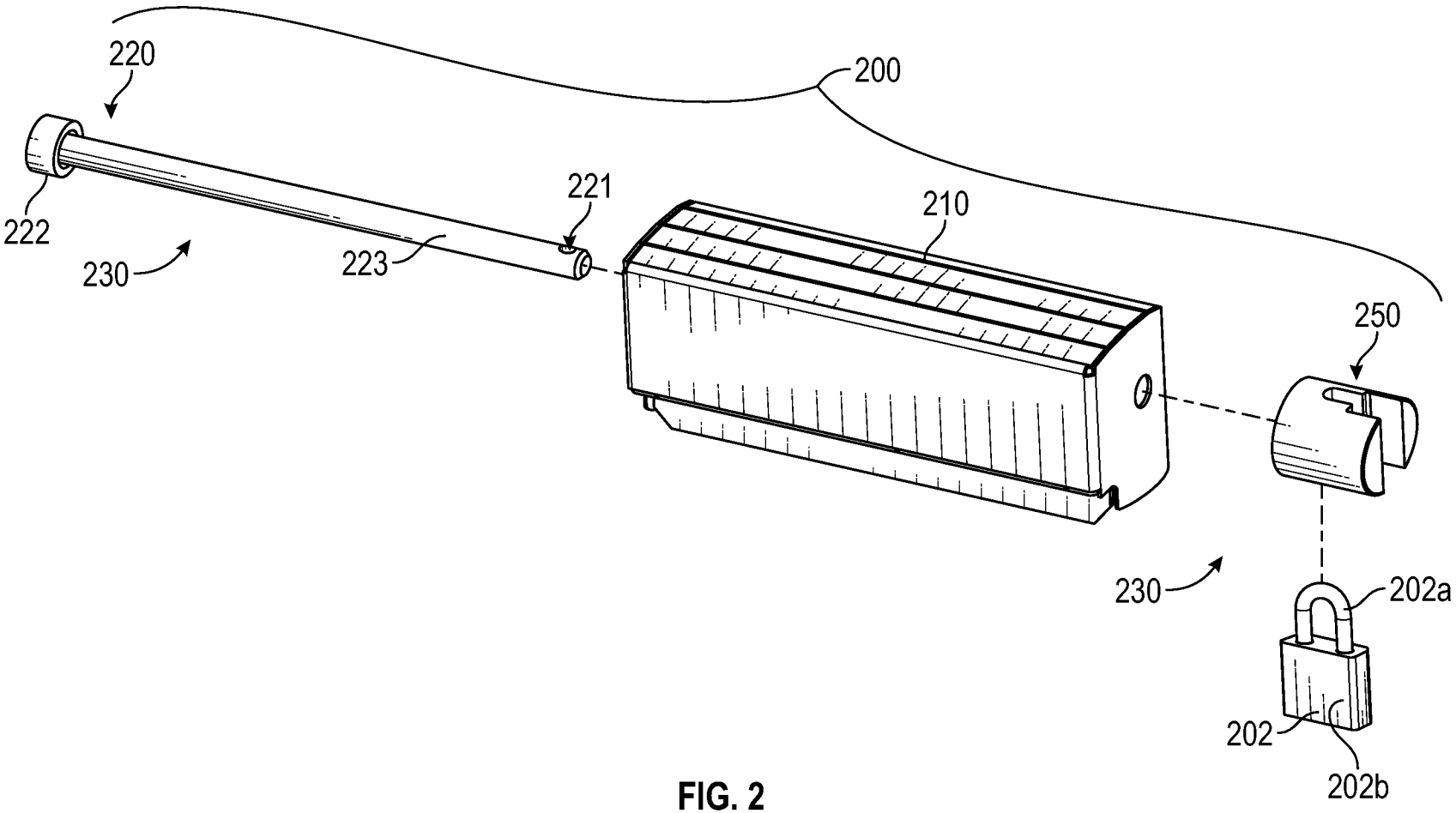
FIG. 2 shows an exploded view of the example lockout device.

FIG. 2 depicts an exploded view of the lockout device 200 in conjunction with a lock 202. The lock 202 includes a shank 202*a* and a body 202*b*. The shank 202*a* can include a u-shaped curved member. The shank 202*a* can be formed of a metal, such as steel. The ends of the shank 202*a* can be fitted within the body 202*b* through an upper surface thereof. The body 202*b* can be generally a rectangular prism having a front side and a back side. The body 202*b* can include internal locking mechanisms for securing and releasing the shank 202*a* from the body 202*b*. The lock 202 can be a conventional lock (e.g., keyed or combination-type padlock) or any other type of lock. The lock 202 can be closed to attach with the locking mechanism 230 and secure the cover 210 in place on the opening 102. The lock 202 can be opened (e.g., with a key) to be removable from the locking mechanism 230 and allow removal of the cover 210 from the opening 102.

The cover 210 is configured to receive portions of a locking mechanism 230 which, when used in conjunction with the cover 210, can lock the cover in place within the opening of the collection box 100. The locking mechanism 230 includes a locking pin 220 and a lock guard 250. The locking pin 220 can include a first end 221, a second end 222 opposite the first end 221 and a body portion 223 therebetween. The body portion 223 can extend from the first end 221 to the second end 222. The locking pin 220 can be inserted through openings formed in the cover and into the lock guard 250. This will be described in greater detail below.

Figure 3A:
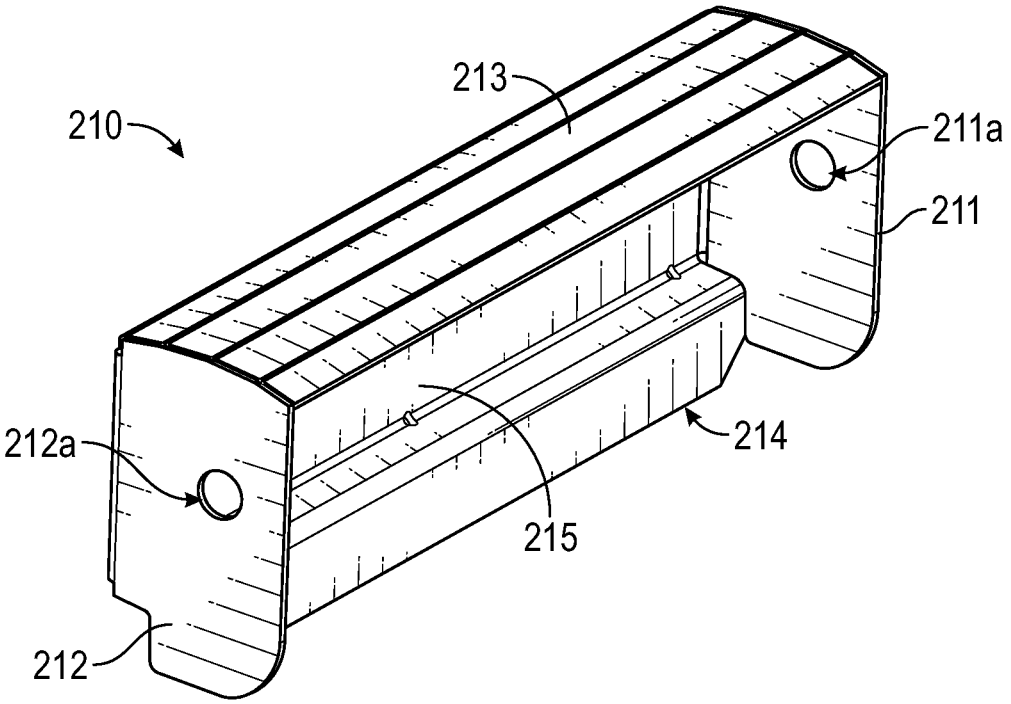
FIG. 3A shows a rear perspective view of a cover of the lockout device.
Figure 3B:
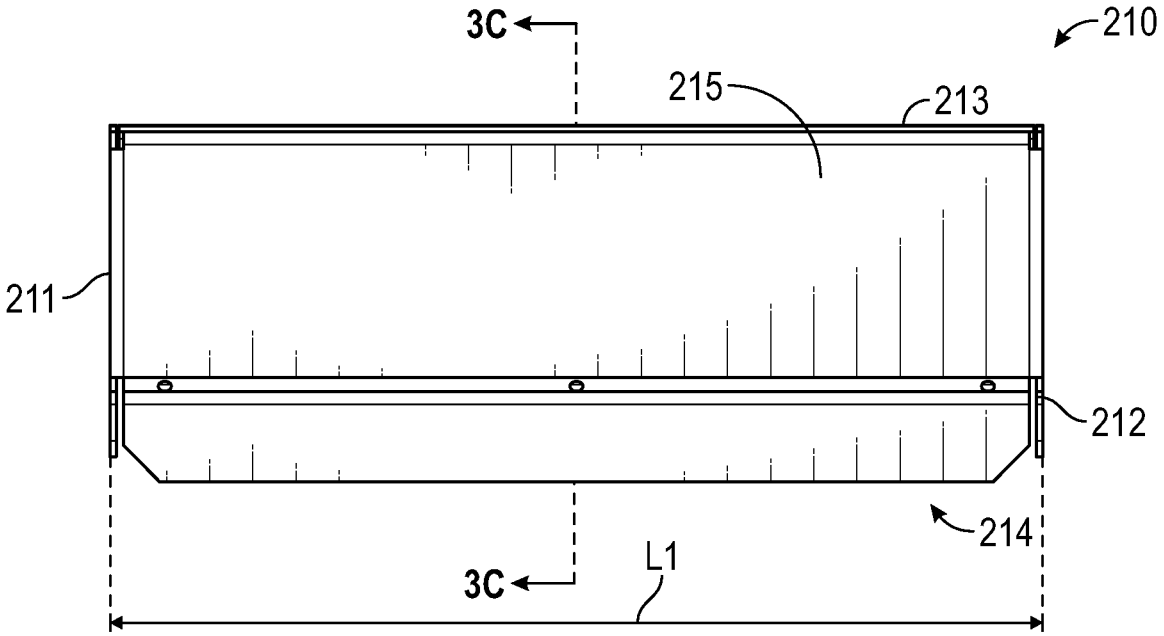
FIG. 3B shows a front view of the cover of the lockout device.
Figure 3C:
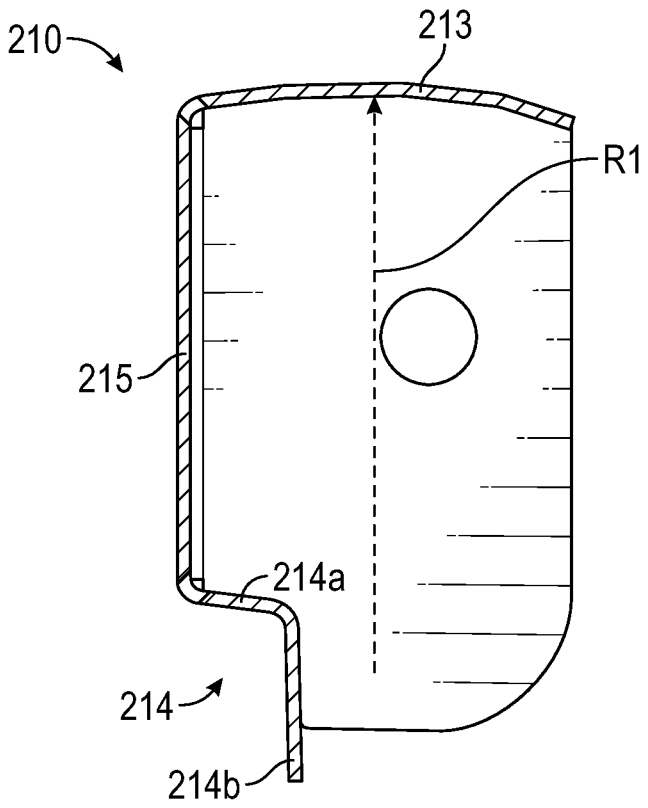
FIG. 3C shows a cross-section view taken along the line 3C-3C in FIG. 3B.

FIGS. 3A-C show views of the cover 210. The cover 210 includes a plurality of members including a first side member 211, a second side member 212, an upper member 213, a lower member 214, and/or a front member 215. The plurality of members of the cover 210 can be formed generally in a parallelepiped. The parallelepiped can be enclosed other than on a bottom portion (e.g., opposite the upper member 213) and/or rear portion (e.g., opposite the front portion 215). The cover 210 can be formed from a single sheet (e.g., steel) with each of the plurality of members folded into the parallelepiped shape. Accordingly, the cover 210 can include a plurality of bends and/or spaces separating each of the plurality of members. Optionally, the cover 210 can include only a subset of the plurality of members. The cover 210 can have an overall length L1.

The first side member 211 can include a flat plate portion. The flat plate portion can be formed of a sheet material. The first side member 211 can be generally rectangularly shaped. The first member 211 can be coupled along one side with the front member 215. The first side member 211 can be formed integrally with the front member 215. The first side member 211 can be coupled with the front member 215 by a bend. The first side member 211 can be parallel with the second side member 212. The first side member 211 can be perpendicular to the front member 215.

The second side member 212 can include a flat plate portion. The flat plate portion can be formed of a sheet material. The second side member 212 can be generally rectangularly shaped. The second side member 212 can be coupled along one side with the front member 215. The second side member 212 can be formed integrally with the front member 215. The second side member 212 can be coupled with the front member 215 by a bend. The second side member 212 can be perpendicular to the front member 215.

The first side member 211 can include a first aperture 211*a*. The first aperture 211*a* can be circular or may have a different shape, such as a rectangular, obround, or an irregular shape. The first aperture 211*a* can extend through the first side member 211. The first aperture 211*a* can be spaced from a perimeter of the first side member 211. The second side member 212 can include a second aperture 212*a*. The second aperture 212*a* can extend through the second side member 212. The second aperture 212*a* can be extended or be aligned with the first aperture 211*a*. The second aperture 212*a* can have the same shape and/or diameter as the first aperture 211*a*.

The front member 215 can be generally rectangular in shape. The front member 215 can be formed of a sheet material. The front member 215 can comprise a planar portion adjoining the first and second side members 211, 212. The front member 215 can include a writing thereon such as "temporarily closed" or other instructions for the lockout device 200. The front member 215 can include a continuous expanse of material from the first side member 211 to the second side member 212.

The lower member 214 can be formed of a sheet material. The lower member 214 can be connected with a lower side of the front member 215 (e.g., at a bend). The lower member 214 can include an L-shaped portion. The lower member 214 can include a first portion 214*a* and a second portion 214*b*. The first portion 214*a* can be coupled with the second portion 214*b* being along a bend. The two portions can be generally perpendicular. The first portion 214*a* can extend in a generally rearward direction from the front panel member 215. The second portion 214*b* can extend generally downwardly from the first portion 214*a*. Each of the first and second portions 214*a* and/or 214*b* can be located between or at least partially between the first and second side members 211, 212. One or both of the first and second side members 211, 212 can include a notch or cutout region corresponding generally to the profile of the lower member 214.

The upper member 213 can be formed of a sheet material. The upper member 213 can include a curved profile having a raised curvature R1, as shown in FIG. 3C. The curved profile of the upper member 213 can be generally formed to correspond to curvature of the upper plate 102*c* of the opening 102. The curvature can ensure that there is a close fit between the cover 210 and the upper plate 102*c*. This can facilitate the secure fit and attachment of the cover 210 with the opening 102. The curved profile of the upper member 213 can be uniform from the first side member 211 to the second side member 212.

Referring again to FIG. 2, the locking mechanism 230 can include a locking pin 220 and a padlock guard 250. As shown further in FIGS. 4A-4B, the locking pin 220 can include a first end 221, a second end 222 opposite the first end 221, and a body portion 223 therebetween. The body portion 223 can extend from the first end 221 to the second end 222. The locking pin 220 can have an overall length L2. In some embodiments, the length L2 can be greater than the overall length L1 of the cover 210.

Figure 4A:
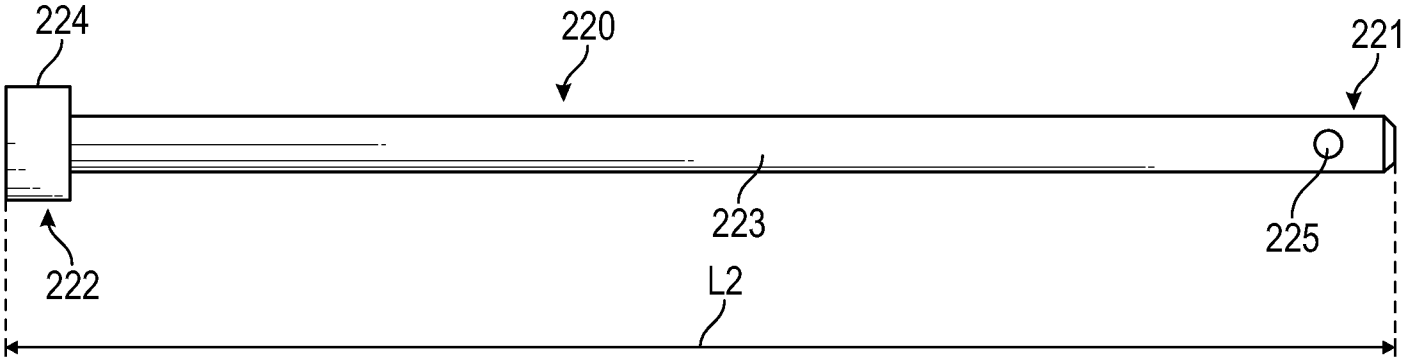
FIG. 4A shows a locking pin of the lockout device.
Figure 4B:
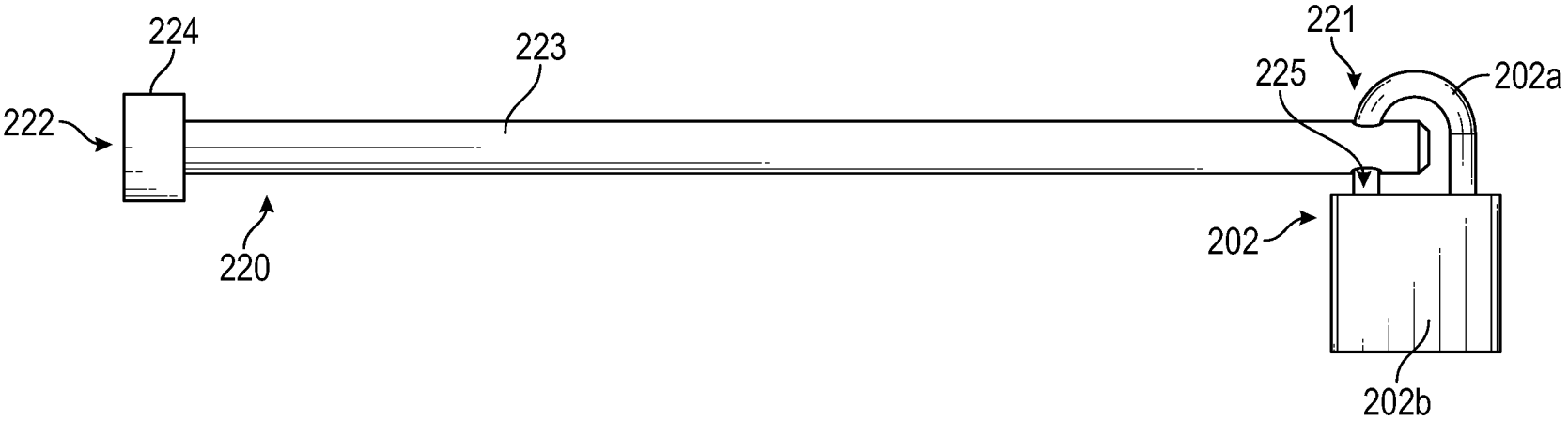
FIG. 4B shows a the locking pin of the lockout device coupled to a lock.

FIGS. 4A-4B show detail of the locking pin 220. The first end 221 of the locking pin 220 can include an orifice 225. The orifice 225 can be a passage extending through the body portion 223. The orifice 225 can have a diameter or dimension sized to receive the shank 202*a* of the padlock 202 therethrough. The second end 222 of the locking pin 220 can include a stop 224. The stop 224 can be a transverse portion of the locking pin 220, relative to the body portion 223. The stop 224 can have a diameter larger than a diameter of the body portion 223. The stop 224 can optionally be a cylindrical member or have a differently shaped cross-sectional profile having at least one dimension greater than the diameter of the body portion 223 (e.g., in a transverse direction relative to an axis of the body portion 223). The stop 224 can further have a diameter larger than a diameter of the first and/or second apertures 211*a*, 212*a* such that the stop 224 prevents the second end 222 of the locking pin 220 from passing through the first and/or second aperture 211*a*, 212*a*.

The body portion 223 can have a diameter or other widthwise dimension. The diameter of the body portion 223 at the first end 221 and along the body portion 223 can be less than diameters or other dimensions of the first and second apertures 211*a*, 212*a* such that first end and the body portion 223 can be inserted at least partially into the cover through the first and/or second apertures 211*a*, 212*a*. Optionally, the cross-sectional shape of the body portion 223 may not be circular, but can be some other shape or profile. The cross sectional shape of the body portion 223 can vary or be uniform from the first end 221 (e.g., orifice 225) to the second end 222 (e.g., stop 224).

FIGS. 5A-5D show details of the lock guard 250. The lock guard 250 can include a body portion 251. The body portion 251 can be formed of a solid material, such as steel or another metal. The body portion 251 can have a generally cylindrical profile or any other shape.

The body portion 251 can include a lock slot 252. The lock slot 252 can divide the lock body into a generally U-shaped configuration. The body portion 251 can include a first wing member 251*a* and a second wing member 251*b* separated by the lock slot 252. An intermediate portion 251*c* can be located between the first and second wing portions 251*a*, 251*b*. The intermediate portion 251*c* can include a shank opening 253. The shank opening 253 can include a diameter sized to receive a shank 202*a* of the lock 202.

The lock slot 252 can include several internal volumes or regions for receiving different portions of the lock 202. The lock slot 252 can include an outer portion 252*a*, an upper portion 252*b*, and/or a lower portion 252*c*. The various portions of the lock slot 252 can be overlapping.

The outer portion 252*a* can be located between the first and second wing portions 251*a*, 251*b* and outward of the intermediate portion 251*c*. The upper portion 252*b* can be located between the first and second wing portions 251*a*, 251*b* and above the intermediate portion 251*c*. The lower portion 252*c* can be located between the first and second wing portions 251*a*, 251*b* and below the intermediate portion 251*c*. The shank opening 253 can extend between the upper portion 252*b* and the lower portion 252*c*.

Figure 5B:
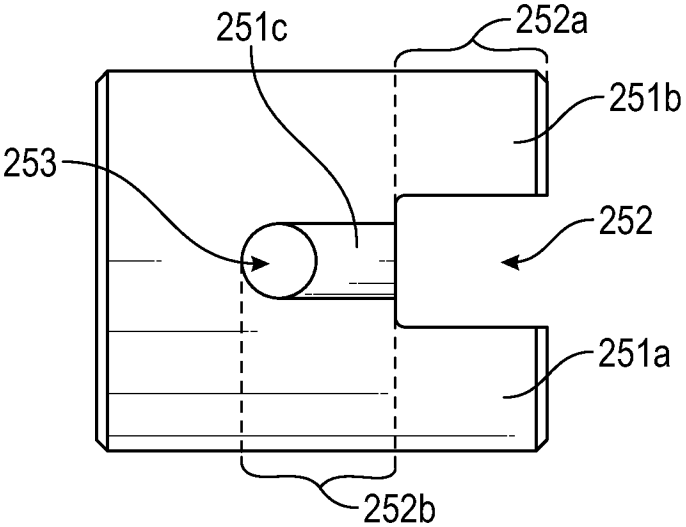
FIG. 5B shows a top view of the lock guard.
Figure 5D:
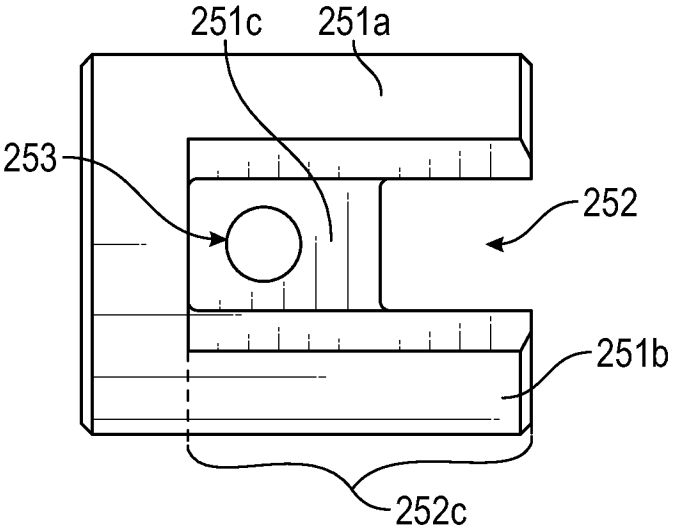
FIG. 5D shows a bottom view of the lock guard.
Figure 5A:
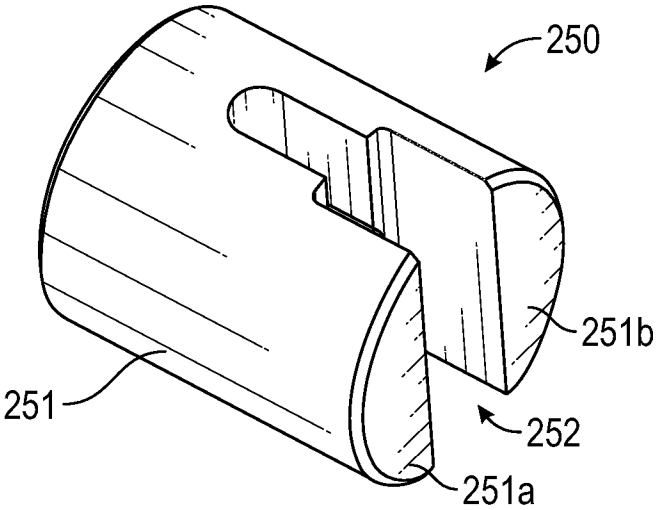
FIG. 5A shows a perspective view of a lock guard of the lockout device.
Figure 5C:
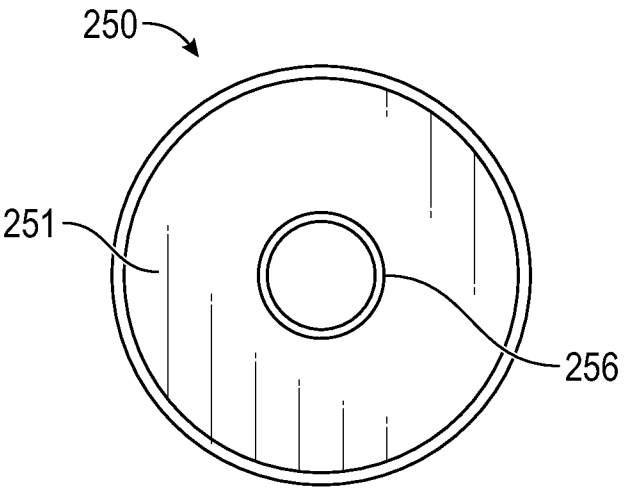
FIG. 5C shows a rear end view of the lock guard.

The body portion 251 can include a pin aperture 256. The pin aperture 256 can extend through an end portion of the body portion 251. The pin aperture 256 can be in communication with the lock slot 252, although this is not required. The pin aperture 256 can be connected with the shank opening 253. The pin aperture 256 can have a cross-sectional shape, as shown in FIG. 5C, sized to receive the first end 221 of the locking pin 220.

Figure 6B:
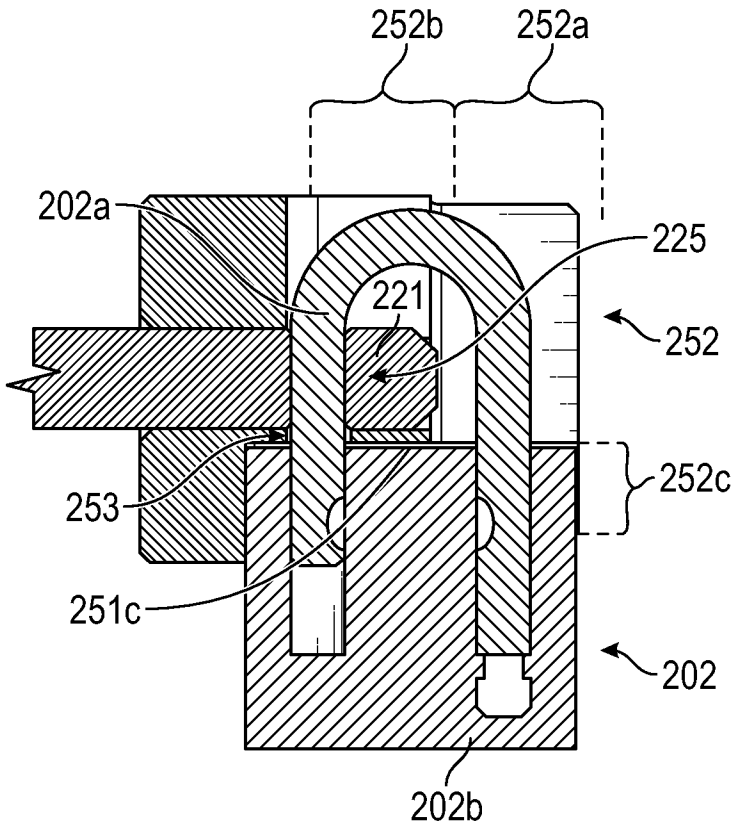
FIG. 6B shows a cross-section view taken along the line 6B-6B in FIG. 6A.
Figure 6A:
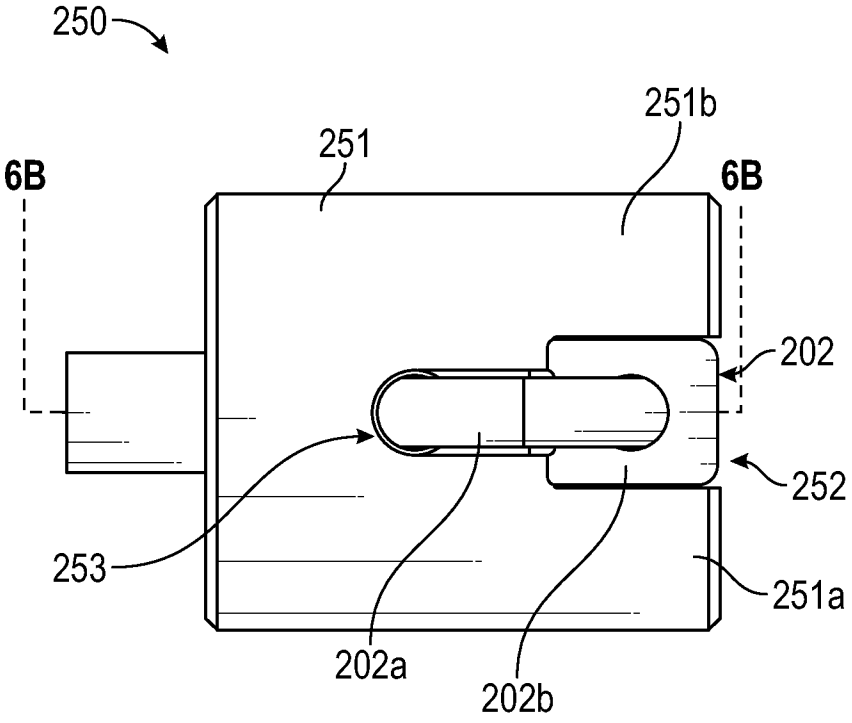
FIG. 6A shows a top view of the lock guard assembled with an end of the locking pin and a lock.

FIGS. 6A-6B show the lock guard secured to a locking pin 220 by a lock 202. As shown in FIGS. 6A-6B, the first end 221 of the locking pin 220 can be inserted within the lock guard 250. The first end 221 with the orifice 225 can be inserted through the pin aperture 256. The orifice 225 can be aligned with the shank opening 253. The lock 202 can be received within the lock slot 252. The shank 202*a* can be inserted into the shank opening 253 and the orifice 225 to secure the locking pin 220 with the lock guard 250. The shank 202*a* can be inserted through the shank opening 253 and the orifice 225 and into the body 202*b* of the lock 202.

The top and bottom of the body portion 251 aligned with the lock slot 252 can be opened to allow the shank 202*a* and the body 202*b* to be positioned within the lock slot 252 and removed therefrom. An upper portion of the body 202*b* can be received within the lower portion 252*c* of the lock slot 252. Accordingly, the lower portion 252*c* can include a height and width sized to receive the upper portion of the lock body 202*b*. A portion of the shank 202*a* can be positioned within the upper portion 252*b* of the lock slot 252. Accordingly, the upper portion 252*b* can include a height and width sized to receive the portion of the shank 202*a*. A portion of the shank 202*a* and the body 202*b* can be positioned within the outer portion 252*a* of the lock slot 252. The first and second wing portions 251*a*, 251*b* can be positioned along front and back sides of the shank 202*a* and/or the lock body 202*b* (or at least an upper portion thereof). Accordingly, the first and second wing portions 251*a*, 251*b* can prevent access to the front and back of the shank 202*a*. This can protect the shank portion 202*a* from being cut or sawed in an attempt to remove the lock guard 250 without unlocking the lock 202.

Figure 7A:
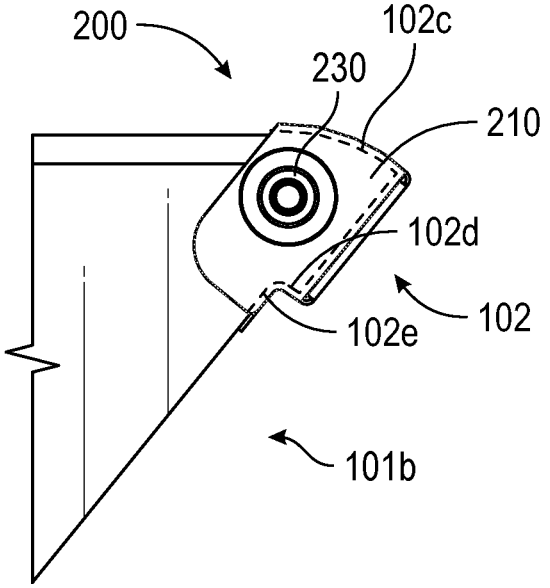
FIG. 7A shows a side view of the lockout device installed within an opening of a collection chute.
Figure 7B:
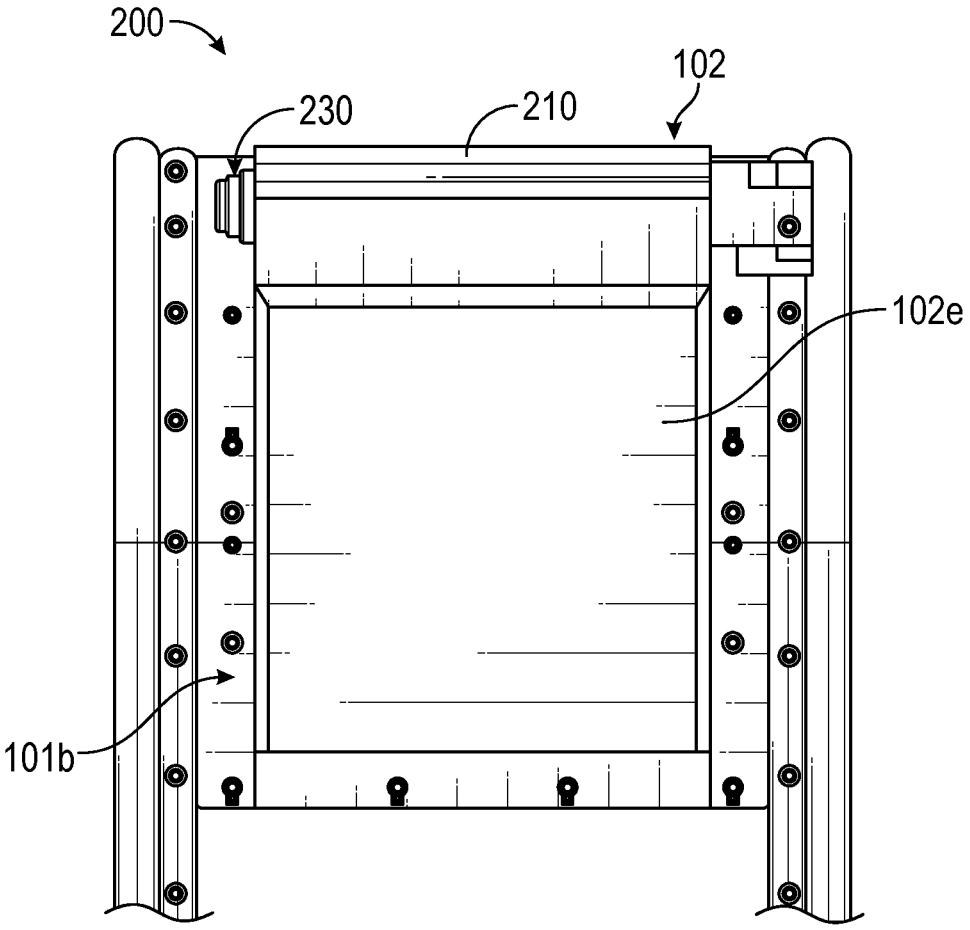
FIG. 7B shows a front view of the lockout device of FIG. 7A installed in the collection chute.

FIGS. 7A and 7B show the lockout device 200 installed over the opening 102 of a collection box 100, as shown in FIG. 1A. The cover 210 can be installed over the opening 102. The front member 215 of the cover 210 can be a blocking member that can block the opening 102 (shown in dash-dash broken lines in FIG. 7A) to prevent access thereto. The upper member 213 can be installed over the upper plate 102*c*. The upper member 213 can generally follow the contours of the upper plate 102*c*. The upper member 213 can fit flush over the upper plate 102*c*. The first side member 211 can be installed over the first side plate 102*a* of the opening 102. The first side member 211 can fit flush over the second side plate 102*a*. The second side member 212 can be installed over the second side plate 102*b* of the opening 102. The second side member 212 can fit flush over the second side plate 102*b*. The first portion 214*a* of the lower member 214 can fit over the lower plate 102*d*. The first portion 214*a* can fit flush against the lower plate 102*d*. The second portion 214*b* can be aligned along a bottom plate 102*e* of the chute 101*b*. The second portion 214*b* can fit flush against the bottom plate 102*e*. The closeness of the fit between the cover 210 and the plurality of sidewalls of the opening 102 can stabilize the position of the cover 210 over the opening 102. The closeness of the fit can prevent unauthorized access around the sides, top or bottom of the cover 210.

Alternatively, the cover 210 can fit within the opening 102. In another alternative, the cover 210 can include one or more portions that fit over the plurality of sidewalls of the opening 102 and one or more portions that fit within the opening 102. Optionally, the cover 210 can include one more flanges that are larger/wider than the opening 102. In one example, the flanges can extend from the front face 215 and generally perpendicular to any of the side member 211, side member 212, upper member 213, and/or lower member 214. The flanges can be located generally co-planar with the front member 215. The flanges can prevent the cover 210 from falling into the chute 101*b* through the opening 102.

Figure 8A:
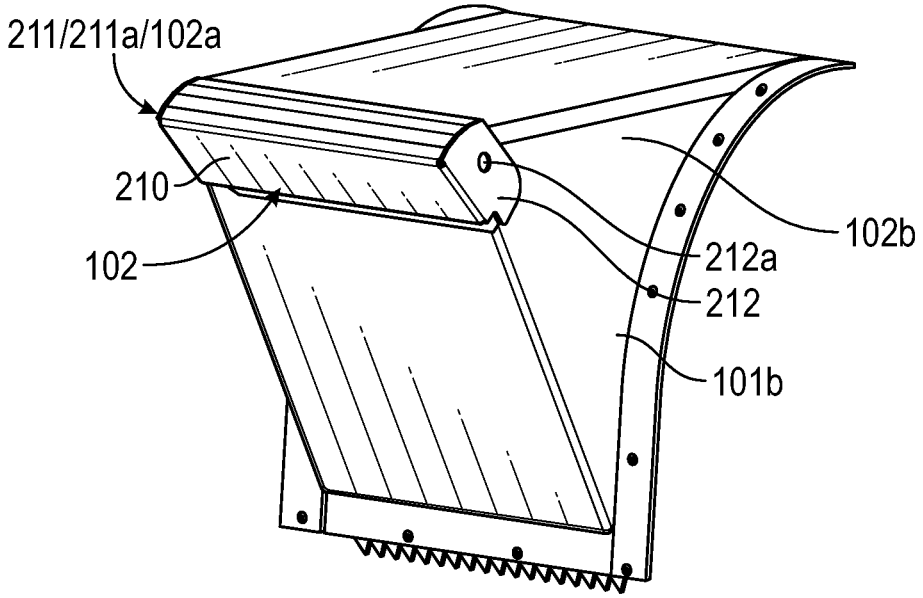
FIG. 8A shows a first step of installing a lockout device in a collection chute.

FIG. 8A shows a first step in installing the lockout device 200 within an opening 102. In some cases, the collection box 100 may not include a hole or aperture in the side plates 102*a-b*. In order to install the cover 210, a hole may need to be created in the side plates 102*a-b*. This first step may only be performed one time for a given collection box 100. The cover 210 can be installed over the opening 102. The first side member 211 and the first aperture 211*a* can be aligned with the first side plate 102*a*. The location where the first aperture 211*a* aligns with the first side plate 102*a* can be marked. Similarly, the second side member 212 can be aligned with the second side plate 102*b*. The location of alignment of the second aperture 212*a* with the second side plate 102*b* can be marked. Thereafter, using a drill or other cutting or boring instrument, the marked areas of the first and second side plates 102*a*, 102*b* material can be removed to form respective passages corresponding to the sizes of the first and second apertures 211*a*, 212*a* and/or corresponding to the sizes of a diameter of the locking pin 220. Once this passage making step has first been performed for a collection box 100, the cover 210 can simply be installed over the opening 102 and the passages of the side plates. In another implementation, the cover 210 can instead be place inside of the opening 102 (e.g., within the side, top, and bottom plates). The marking and removing methodology can be repeated with this variation.

Figure 8B:
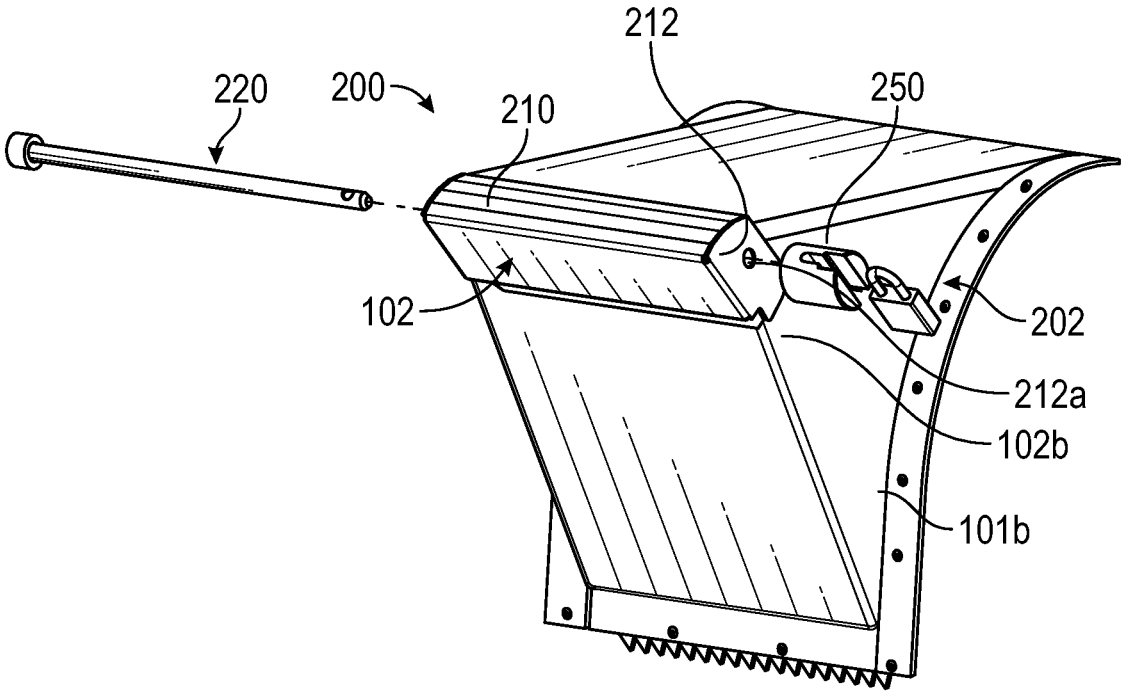
FIG. 8B shows a second step of installing a lockout device in a collection chute.

FIG. 8B shows a second step of inserting the locking pin 220 through the passages and the cover 210. The first end 221 can be inserted through the first aperture 211*a*, the passage of the first side plate 102*a*, the passage of the second side plate 102*b* and into the second aperture 212*a*. Since the length L2 of the locking pin 220 is greater than the length L1 of the cover 210 (FIGS. 3B and 4A), the first end 221 of the locking pin 220 will protrude from the second aperture 212*a*. The stop mechanism 224 with prevent further advancing of the locking pin 220 after a certain point. Optionally, the protruding first end 221 can be inserted into the lock guard 250 (e.g., into the receiving pin aperture 256). The lock 202 can be shackled with the locking pin 220 at the orifice 225. Once locked in place by the lock 202, the locking pin 220 cannot be retracted back through the cover 210 because of interference with the shank 202*a*. Furthermore, the locking pin 220 cannot be advanced because of interference with the stop member 224 on the locking pin 220, the stop member 224 having a greater diameter than the passages and/or first and second apertures 211*a*, 212*a*. Accordingly, the cover 210 can be locked in place over the opening 102 by the locking mechanism 230.

Figure 9A:
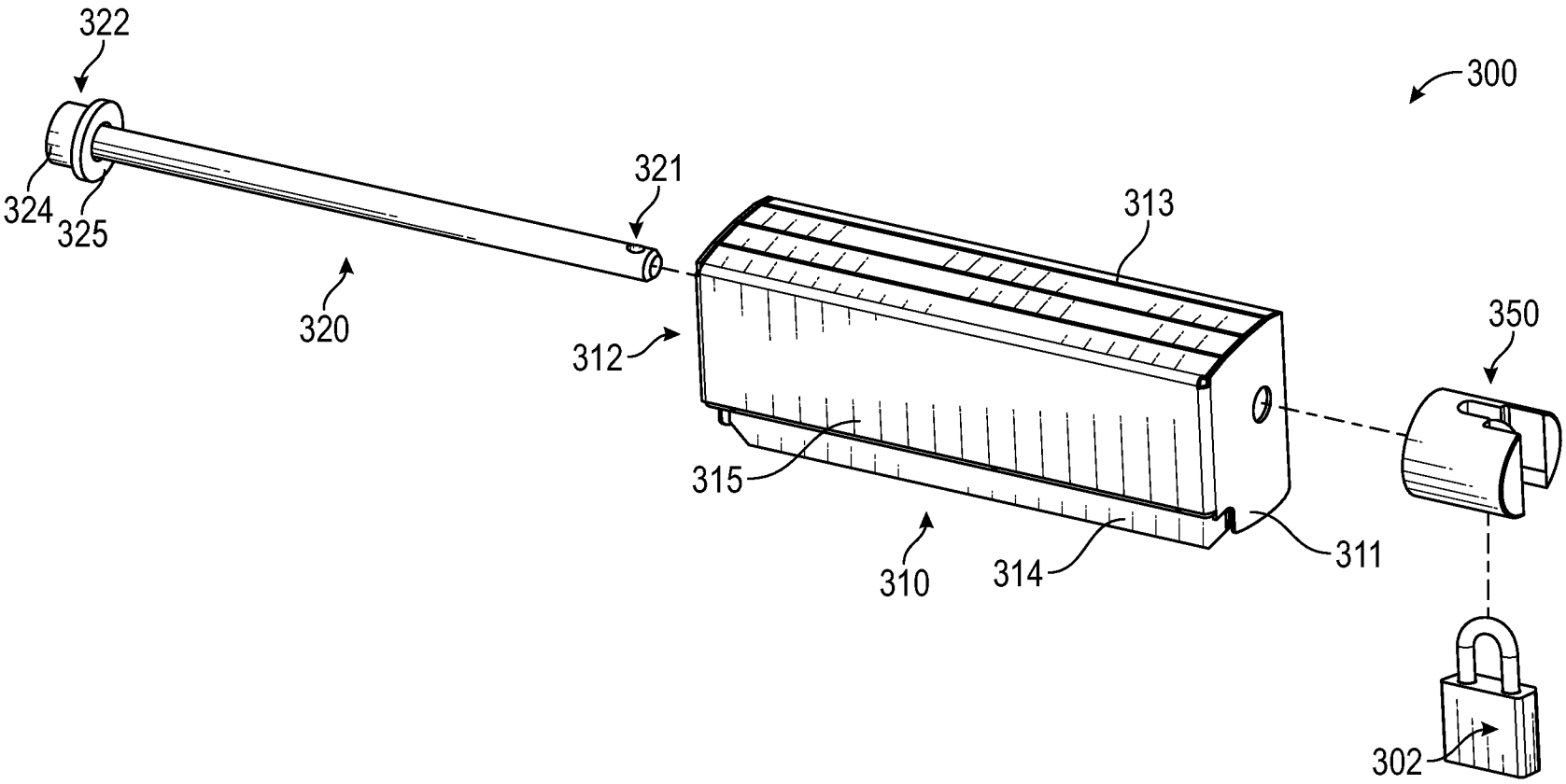
FIG. 9A shows an exploded view of an example lockout device.
Figure 9B:
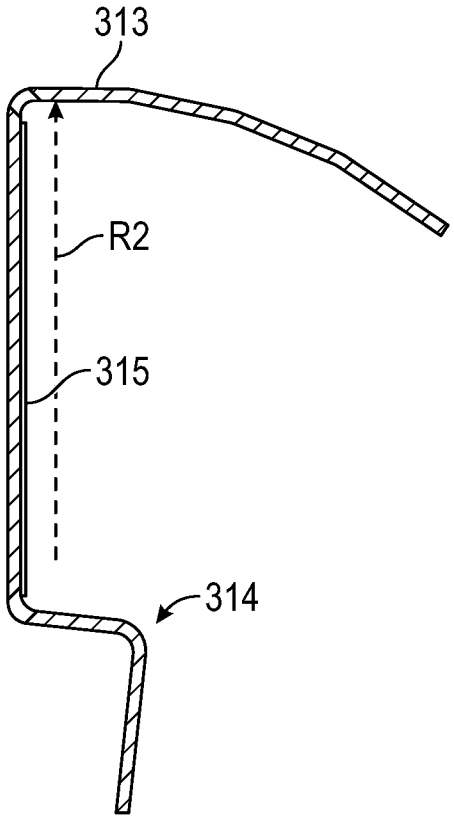
FIG. 9B shows a section view of a cover of the lockout device.

FIGS. 9A and 9B show an embodiment of a lockout device 300. The lockout device 300 can include a cover 310. The cover 310 can generally have the same components as the cover 210 with the differences noted herein. The cover 310 can include a first side member 311, a second side member 312, a lower member 314, an upper member 313 and/or front member 315. Apertures can be located in the first and second side members 311, 312. A locking mechanism can include a pin member 320. The pin member 320 can include a first end 321 including an orifice and second end 322 including a stop 324. The stop 324 may include a washer 325. The washer 325 can be separate from the stop 324 and/or the cover 310. The washer 325 can have an outer diameter larger than the diameter of the stop 324 and an inner diameter larger than the locking pin 320 but smaller than the diameter of the stop 324. The locking mechanism can further include a lock guard 350 and/or a lock 302. As shown in FIG. 9B, the cover 310 can include the upper member 313 having a raise of curvature R2. Radius of curvature R2 can differ from the radius of curvature R1 of the upper member 213. The curvature of the upper member 313 can be selected based on the geometry of the opening of the collection box.

Figure 10A:
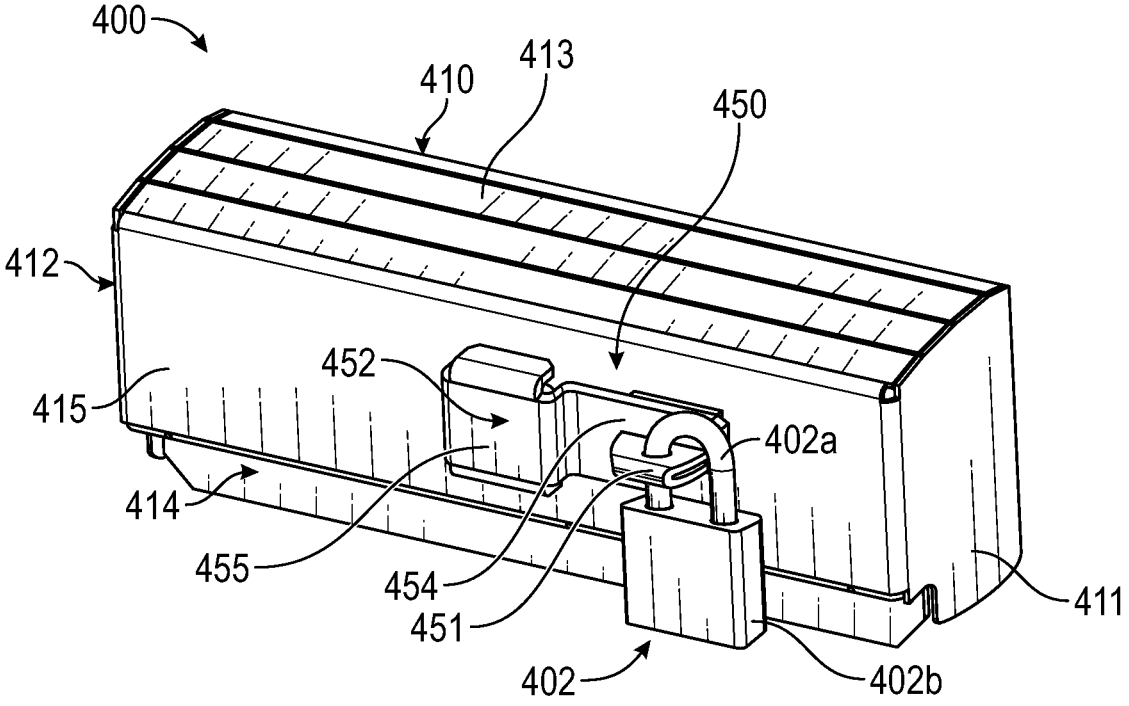
FIG. 10A shows a perspective view of another example lockout device.
Figure 10B:
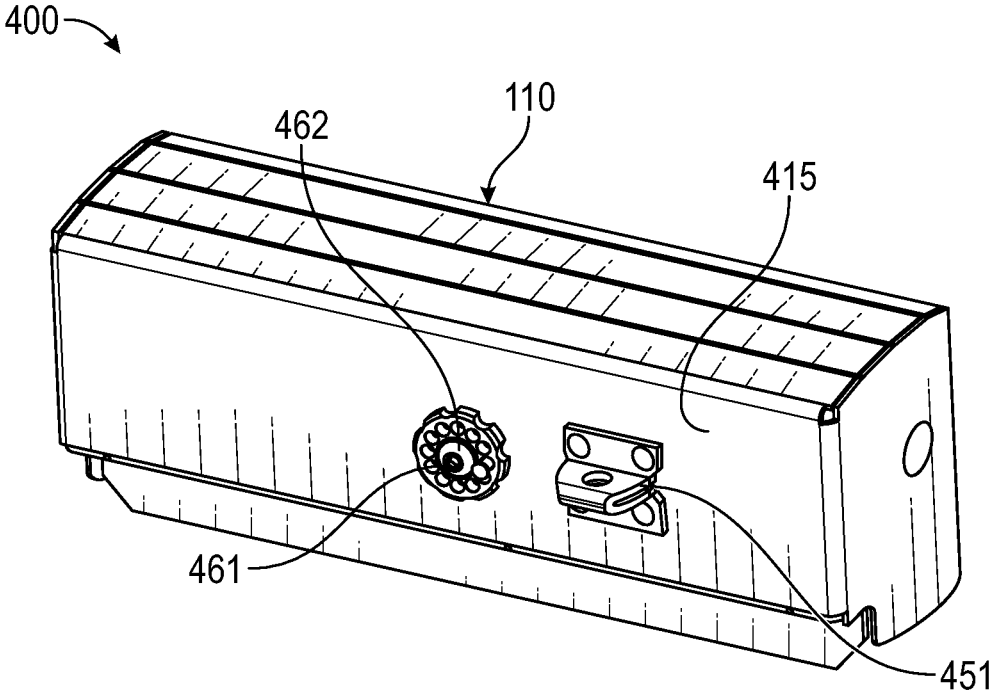
FIG. 10B shows a perspective view of the lockout device of FIG. 10A with a hasp removed.

FIGS. 10A-10B illustrate an embodiment of a lockout device 400. The lockout device 400 can include a cover 410. The cover 410 can be shaped similar to the cover 210 described above. The cover 410 can be generally formed as a rectangular parallelepiped having an open bottom and/or rear portion. The cover 410 can include a first side member 411, a second side member 412, an upper member 413, a lower member 414, and a front member 415. The cover 410 can be formed of a single sheet or plate material with each of the corresponding members formed by bended corners in the sheet material.

The lockout device 400 can be locked in conjunction with a hasp 450. The hasp 450 can include an eyelet member 451 and/or a slot member 452. The eyelet member 451 can be coupled with the front member 415. The eyelet member 451 can protrude transversely from the front member 415. The eyelet member 451 can include an aperture. The aperture can be sized for receiving a shank 402*a* of a lock 402.

The hasp 450 can include a slot member 452. The slot member 452 can include a slotted portion 454. The slotted portion 454 can include a slot. The slot can be received over the eyelet portion 451. The slot member 452 can include a lock end 455. The lock end 455 can be located at one end of the slotted portion 454. The lock end 455 can include a cup-portion. The cup-portion can be formed by one or more flanges bent towards the front member 415 (as installed). The lock end 455 can include a pin 456. The pin 456 can be a cylindrical member extending from the lock end 455. The pin 456 can be located on an inner side of the lock end 455 (such as within the cup-portion).

The lockout device 400 can include a shaft control end 461. The shaft control end 461 can be pivotably mounted on the cover 410. The shaft control end 461 can be in the form of a wheel having a plurality of apertures located at intervals around a perimeter of the wheel. The shaft control end 461 can be mounted with an end bolt 462.

Figure 11:
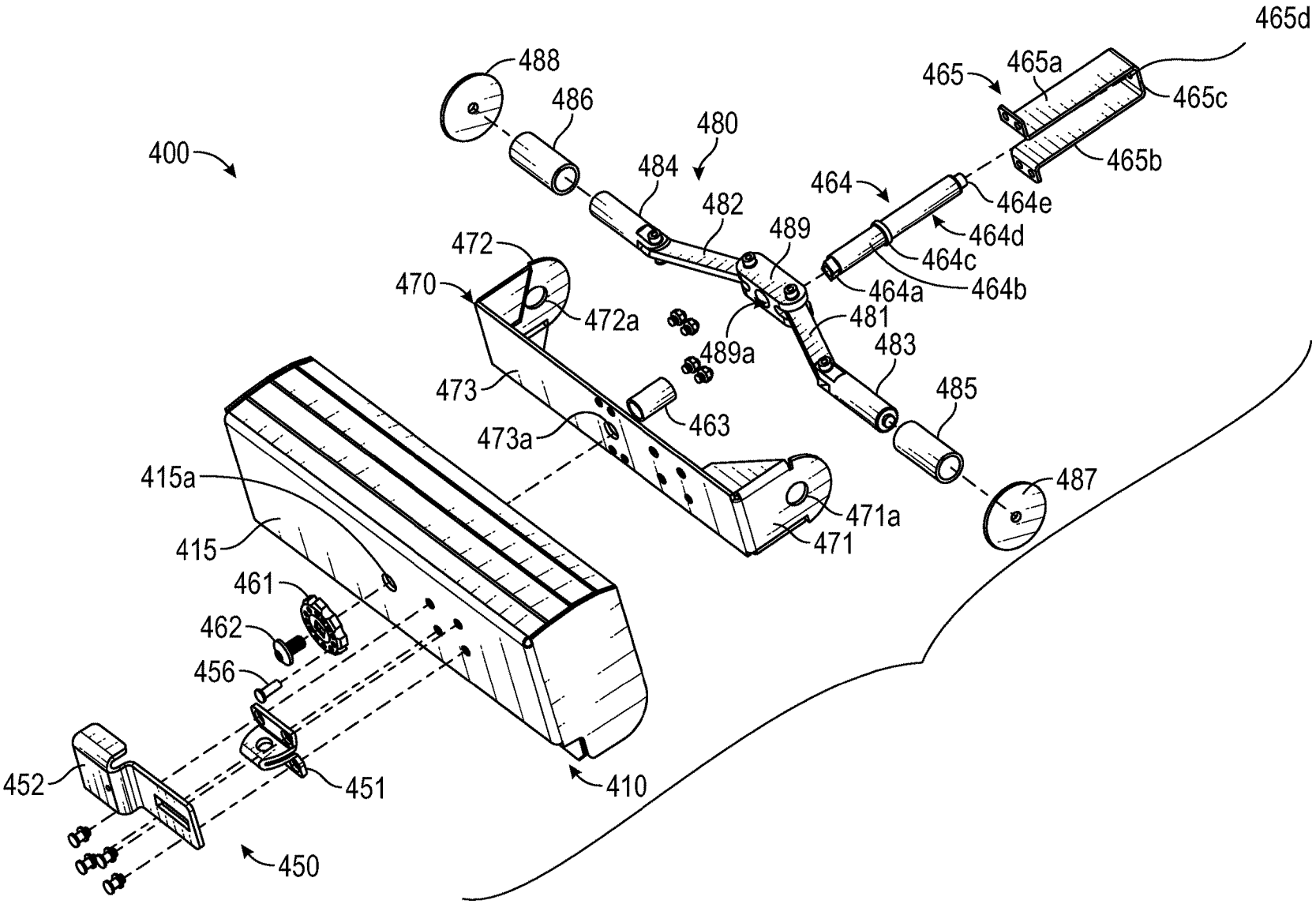
FIG. 11 shows an exploded view of the lockout device of FIGS. 10A and 10B.
Figure 12A:
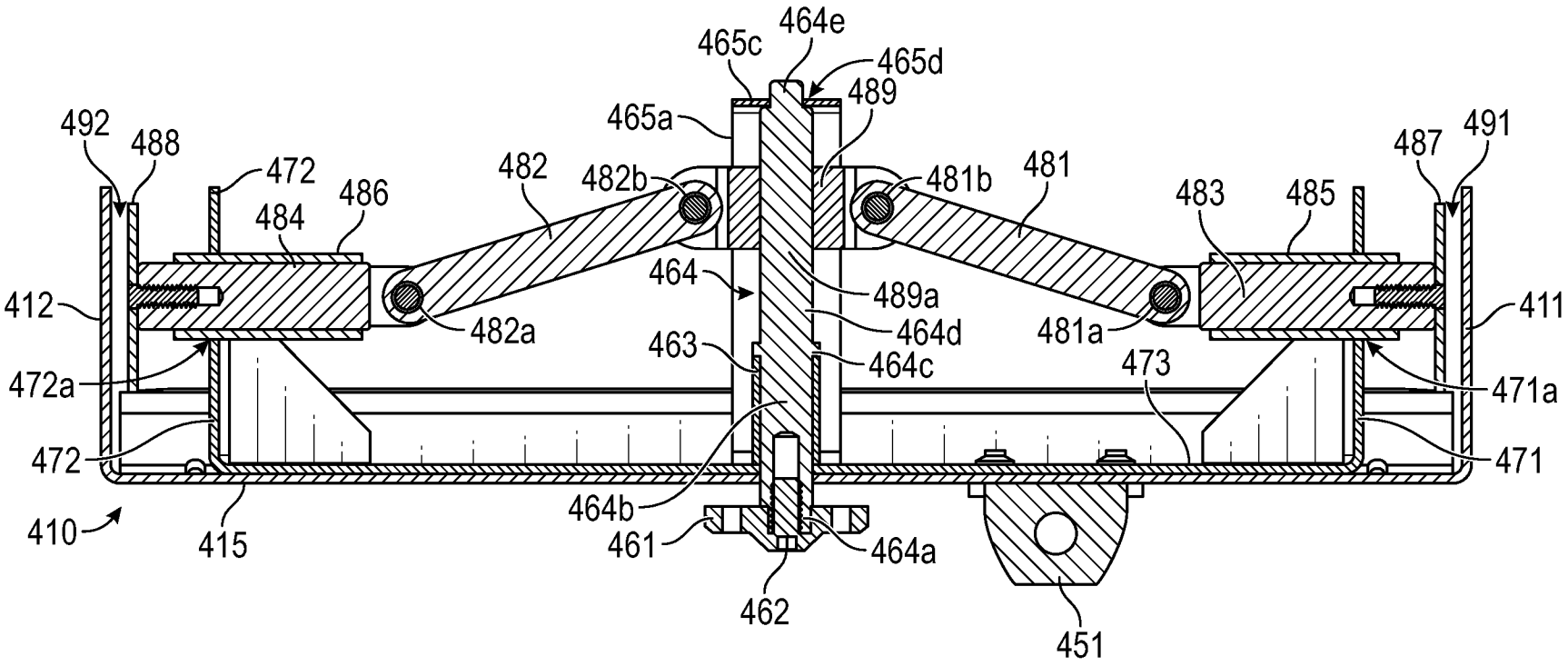
FIG. 12A shows a retracted configuration of the clamping assembly of the lockout device of FIGS. 10A-11.
Figure 12B:
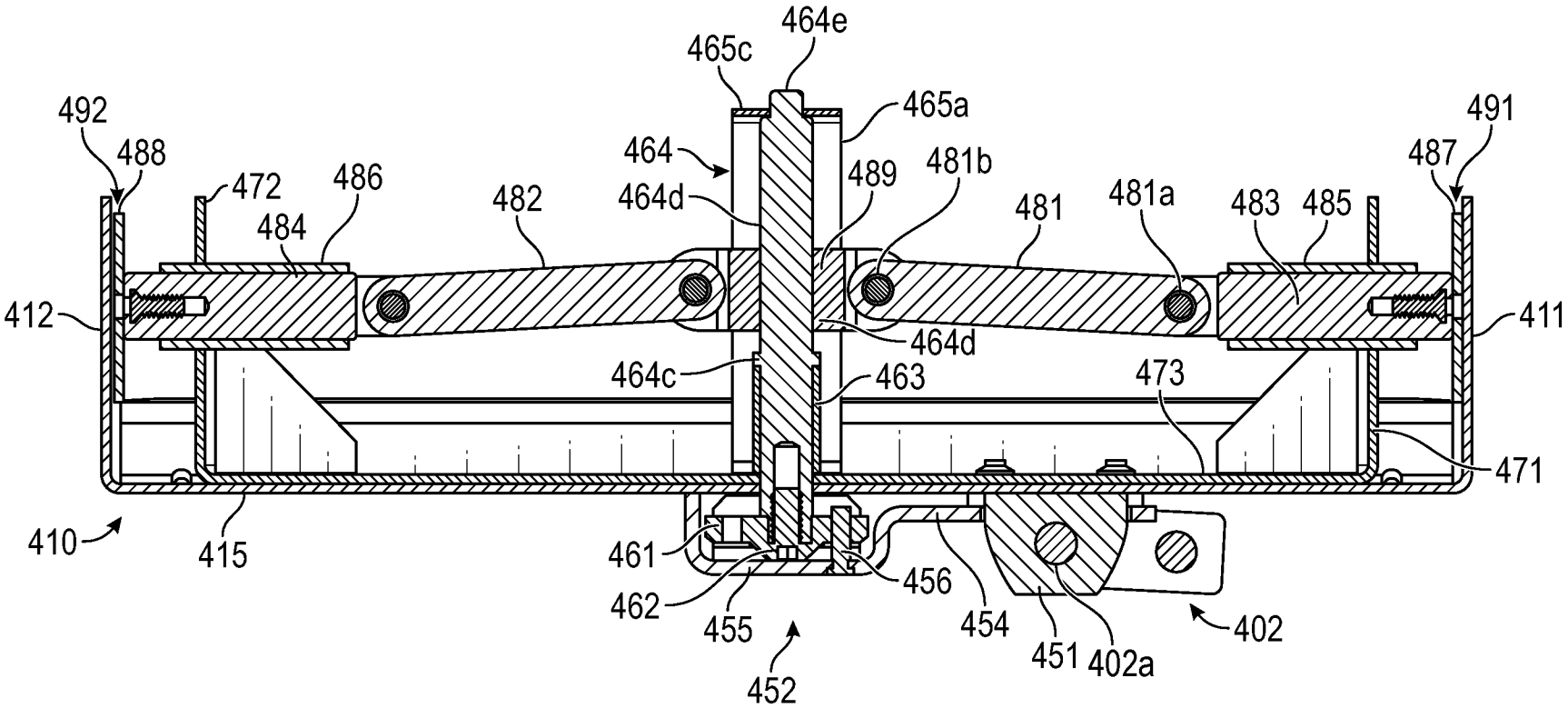
FIG. 12B shows an extended configuration of the clamping assembly of the lockout device of FIGS. 10A-12.

FIG. 11 depicts an exploded view of the lockout device 400 and FIGS. 12A-B depicts a clamping assembly disposed within the lockout device 400. The lockout device 400 can include an extension assembly 480 for securing the locking cover 410 within the opening 102. The extension assembly 480 can include a brace member 470. The brace member 470 can include a first side member 471. The first side member 471 can include a first aperture 471*a*. The brace member 470 can include a second side member 472. The second side member 472 can have a second aperture 472*a*. The first and second apertures 471*a* and 472*a* can be aligned. The first side member 471 can be coupled at a first end of a front member 473. The second side member 472 can be connected at an opposite end with the front member 473 from the first member 471. The first member 471 can be generally perpendicular with the front member 473. The second member 472 can be generally perpendicular with the front member 473. The brace member 470 can be formed of a single sheet of a plate material having one or more bends to form the first and second side members 471, 472. The front member 473 can include an aperture 473*a* for receiving a shaft 464. The aperture 473*a* can be aligned with an aperture 415*a* in the front member 415.

The extension assembly 480 can include a linkage assembly. A first side of the linkage assembly can include a first link 481. The first link 481 can include first and second ends 481*a*, 481*b*. The first end 481*a* can be pivotally coupled with a piston member 483. The piston member 483 can be slidingly engaged with a guide or piston cylinder 485. The piston cylinder 485 can comprise a cylindrical member having an aperture therein. The aperture can include a circular or other cross-sectional shapes that receives the cross-sectional shapes of the piston member 483. The cylinder member 485 can be mounted on the first side member 471 such as within the aperture 415*a*. The piston member 483 can be coupled with an extension member 487. One end of the extension member 487 can include a shaft that engages with a thread on the piston member 483. On opposite end of the extension member 487 can include an enlarged planar portion. The planar portion can include a rubberized surface or otherwise roughened or textured outer face.

The second end 481*b* of the first link 481 can be pivotally coupled with a nut 489. The nut 489 can include an interior aperture 489*a*. The interior aperture 489*a* can include one or more internal threads.

A second side of the linkage assembly can include a second link 482. The second link 482 can be equivalent to the first link. The second link 482 can include ends 482*a*, 482*b*, a second piston member 484 slidingly mounted in a second piston cylinder 486, and a second extension member 488. The second piston cylinder 486 can be mounted on the second side member 472 such as within the second aperture 472*a*. The second piston member 484 can reciprocate within the second piston cylinder 486. The second link 482 can be coupled on the first and second ends 482*a*, 482*b* with the second piston member 484 and the nut 489, respectively.

The extension assembly 480 can include a shaft 464 for actuating the linkage assembly between an extended configuration and a retracted configuration. The shaft 464 can include a first end 464*a*. The first end 464*a* can include an anti-rotation end shape (e.g., square). The first end 464*a* can include a seat having one or more internal threads. The shaft 464 can include a first portion 464*b*. The first portion 464*b* can include a smooth outer surface and/or circular cross-sectional shape. The shaft 464 can include a ridge 464*c*. The ridge 464*c* can be a raised circumferential portion. The shaft 464 can include a second portion 464*d*. The second portion 464*d* can include a threaded region having one or more threads in the manner of a screw. The second portion 464*d* can be separated from the first portion 464*b* by the ridge 464*c*. A second end 464*e* of the shaft 464 can include a tapered portion. The second end 464*e* can be cylindrical in cross-section.

The extension assembly 480 can include a sleeve 463. The sleeve 463 can be a cylindrical member having an aperture therethrough. The sleeve 463 can be mounted on the shaft 464. The sleeve 463 can be mounted on the first portion 464*b* and abut the ridge 464*c*.

The extension assembly 480 can include a shaft support 465. The shaft support 465 can include first and second support members 465*a*, 465*b*. The first and second support members 465*a*, 465*b* can include transverse mounting flanges for coupling with the front member 415. The first and second support members 465*a*, 465*b* can be generally formed in a U-shape. An intermediate portion 465*c* can bridge the first and second support members 465*a*, 465*b*. The first and second support members 465*a*, 465*b* can be generally parallel. The first and second support members 465*a*, 465*b* can be orthogonal to the intermediate portion 465*c*. The intermediate portion 465*c* can include a circular opening 465*d*.

The opening 465*c* can receive the second end 464*e*. The function of the shaft support 465 is to steady rotation of the shaft 464 by providing two pivot locations at 465*c* and at 415*a*. Thus, the shaft 464 can rotate in place.

In an assembled configuration of the extension assembly 480, the brace member 470 can be assembled with the cover 410. The front member 473 can be aligned with the front member 415 and optionally attached thereto using mechanical fastening implements. The first and second side members 471, 472 can be aligned between the first and second side members 411, 412. The extension members 487, 488 can face outward towards the respective first and second side members 411, 412. In the retracted configuration, spaces 491, 492 can be located between the extension members 487, 488 and the respective first and second side members 411, 412.

The first end 464*a* of the shaft 464 can be mounted through the aperture 415*a* in the front member 473. The first end 464*a* can be coupled with the shaft control end 461. The shaft control end 461 can include an inner aperture that receives the first end 464*a* in a non-rotational manner. The shaft control end 461 can be coupled with the shaft 464 through the non-rotational coupling. The end bolt 462 can be mounted in the first end 464*a* to secure the shaft control end 461 to the shaft 464.

The sleeve 463 can control a spacing between the shaft control end 461 and the front face of the front member 415. The sleeve 463 can be a bushing that can facilitate rotation of the shaft 464 relative to the front member 473 and/or 473. The second end 464*a* of the shaft 464 can be supported by the shaft support 465. The first and second support members 465*a*, 465*b* can be coupled (on the flanges) with the front member 473 on either side of the aperture 473*a*. The intermediate portion 465*c* can be aligned with the shaft 464. The opening 465*d* can receive the second end 464*e* of the shaft and be pivotally mounted therein. The function of the shaft support 465 can steady rotation of the shaft 464 by providing two pivot locations at 465*c* and at 415*a*.

The nut 489 can be mounted on the second portion 464*d*. The second portion 464*d* can be located within the aperture 489*a*. Threads of the nut 489 can engage with threads of the second portion 464*d*. Rotation of the shaft 464 (e.g., through the shaft control end 461) can translate the nut 489 along an axis of the shaft 464. The first and second links 481, 482 can be coupled with the nut 489. The first and second links 481, 482 can also be coupled with the piston member 483, 484, respectively.

In operation, as shown in FIGS. 12A and 12B, rotation of the shaft 464 in a first direction translates the nut 489 along the second portion 464*d* in a first direction to extend the extension members 487, 488 through the links 481, 482 towards the respective side members 411, 412. The translation of the nut 489 can cause translation of the extension member 487 and the piston 483 through the link 481. The shaft 464 can be rotated by engagement with the shaft control end 461 on an exterior side of the front member 415. Rotation of the shaft 464 in a second (opposite) direction translates the nut 489 along the second portion 464*d* in a second direction to retract the extension members 487, 488 through the links 481, 482 away from the respective side members 411, 412. The translation of the nut 489 can cause translation of the extension member 488 and the second piston member 484 through the second link 482. Translation of the nut 489 can be limited by interference with the ridge 464*c* in a first direction and/or the intermediate portion 465*c* in a second direction. The first and second support members 465*a*, 465*b* can engage with and guide the movement of the nut 489. The support members 465*a*, 465*b* can prevent rotation of the nut 489 with the rotation of the shaft 464.

The cover 410 can be installed over the plurality of sides of the opening 102. The first side plate 102*a* can be received within the space 491. In the extended configuration, the extension member 487 can engage an inner side of the side plate 102*a* to secure the lockout device 400 within the opening 102. The second side plate 102*b* can be received within the space 492. The extension member 488 can engage an inner side of the side plate 102*b* to secure the lockout device 400 within the opening 102. The extension assembly 480 can be transitioned to the retracted configuration to release the cover 410 from the opening 102 in the reverse manner.

The extension assembly 480 can be locked in the extended configuration. In the locked configuration (FIG. 12B), the pin 456 mounted on the hasp 450 can engage with the shaft control end 461 to secure it against rotation. The shaft control end 461 can received the pin 456 with the lock end 455 assembled over the shaft control end 461. The slotted portion 454 can be assembled over the eyelet member 451. The lock 402 can be coupled with opening in the eyelet member 451 to secure the hasp 450 closed. Thereby the lock 402 can lock rotation of the shaft 464 and secure the extension assembly 480 in the extended configuration. The lock end 455 mounted over the shaft control end 461 can also shield the shaft control end 461 and/or the pin 456 from tampering.

A method using the lockout device 400 includes assembling the cover 410 over the opening 102 with the first and second side plates 102*a*, 102*b* located in the spaces 491, 492, respectively, rotating the shaft 464 to transition the extension assembly 480 into the extended configuration engaged with inner sides of the first and second side plate 102*a*, 102*b*. The hasp 450 can be assembled with the front member 415 and locked in place. The pin 456 can block rotation of the shaft 464 by engaging with the shaft control end 461. The lock can secure the hasp 450 in place. Removal of the lockout device 400 can include the reverse of these steps.

The lockout device 400 provides various advantages. The lockout device 400 does not require altering the plates that bound the opening 102. Accordingly, the lockout device 400 can be more quickly and easily installed on a collection box. The lockout device 400 can also be used in a variety of different locations and avoid permanently damaging or altering collection boxes or chutes. This can be particularly advantageous where locking collection boxes is done only on a temporary basis. The lockout device 400 is also adjustable. The extension assembly 480 can be tightened to fit secure on a given opening.

Another advantage is the design of the link assembly. As the nut 489 moves towards the ridge 464*c*, the first and second ends 481*a*, 481*b* of the link 481 begin to align. As the first and second ends 481*a*, 481*b* align, the mechanical advantage of the link assembly increases. At the alignment point of the nut 489 with the first and second ends 481*a*, 481*b*, the nut 489 can impose a theoretical infinite mechanical advantage on the piston members. In the real world, this position can represent a spike in the forces on the piston members. Optionally, the Terms of orientation used herein, such as "top," "bottom," "proximal," "distal," "longitudinal," "lateral," and "end," are used in the context of the illustrated example. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain examples include or do not include, certain features, elements, and/or steps. Thus, such conditional language is not generally intended to imply that features, elements, and/or steps are in any way required for one or more examples.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain examples require the presence of at least one of X, at least one of Y, and at least one of Z.

The terms "approximately," "about," and "substantially" as used herein represent an amount close to the stated amount that still performs a desired function or achieves a desired result. For example, in some examples, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain examples, as the context may dictate, the term "generally parallel" can refer to something that departs from exactly parallel by less than or equal to 20 degrees. All ranges are inclusive of endpoints.

Summary

Several illustrative examples of lockout devices have been disclosed. Although this disclosure has been described in terms of certain illustrative examples and uses, other examples and other uses, including examples and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various examples. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one example in this disclosure can be combined or used with (or instead of) any other portion of any of the steps, processes, structures, and/or devices disclosed or illustrated in a different example or flowchart. The examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative examples have been described, any examples having equivalent elements, modifications, omissions, and/or combinations are also within the scope of this disclosure. Moreover, although certain aspects, advantages, and novel features are described herein, not necessarily all such advantages may be achieved in accordance with any particular example. For example, some examples within the scope of this disclosure achieve one advantage, or a group of advantages, as taught herein without necessarily achieving other advantages taught or suggested herein. Further, some examples may achieve different advantages than those taught or suggested herein.

Some examples have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various examples can be used in all other examples set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular example of the inventions disclosed herein. No aspects of this disclosure are essential or indispensable. In many examples, the devices, systems, and methods may be configured differently than illustrated in the figures or description herein. For example, various functionalities provided by the illustrated modules can be combined, rearranged, added, or deleted. In some implementations, additional or different processors or modules may perform some or all of the functionalities described with reference to the examples described and illustrated in the figures. Many implementation variations are possible. Any of the features, structures, steps, or processes disclosed in this specification can be included in any example.

In summary, various examples of lockout devices and related methods have been disclosed. This disclosure extends beyond the specifically disclosed examples to other alternative examples and/or other uses of the examples, as well as to certain modifications and equivalents thereof. Moreover, this disclosure expressly contemplates that various features and aspects of the disclosed examples can be combined with, or substituted for, one another. Accordingly, the scope of this disclosure should not be limited by the particular disclosed examples described above, but should be determined only by a fair reading of the claims.

What is claimed is:

1. A lockout device for an item receptacle, comprising:

a cover sized and shaped to be installed on an opening of the item receptacle, the cover comprising:

a first side member having a first aperture formed therethrough;

a second side member opposite the first side member, the second side member having a second aperture formed therethrough; and a front face extending from the first side member to the second side member, the front face oriented to block the opening when the cover is installed; and a locking pin comprising:

a first end having an orifice configured to receive a shank of a lock; and a second end;

wherein the locking pin is insertable into the first and second apertures to secure the cover in place over the opening of the item receptacle.

2. The lockout device of claim 1, wherein the first side member of the cover is configured to be positioned along a first side plate defining a first side of the opening and wherein the second side member of the cover is configured to be positioned along a second side plate defining a second side of the opening opposite the first side.

3. The lockout device of claim 2, wherein the first aperture is configured to be aligned with a first passage formed in the first side plate and the second aperture configured to be aligned with a second passage formed in the second side plate such that the locking pin is insertable through the first and second passages.

4. The lockout device of claim 1, further comprising an upper member, wherein the front face, the upper member, and the first and second side members generally form a rectangular parallelepiped having an open rear side, and wherein the upper member comprises a plate configured to extend along an upper plate bounding the opening of the item receptacle, the plate having a curved cross-sectional profile corresponding to a curvature of the upper plate.

5. The lockout device of claim 1, further comprising a lower flange abutting the front face, the lower flange configured to extend along a lower plate bounding the opening of the item receptacle.

6. The lockout device of claim 5, wherein the lower flange comprises a first portion and a second portion in an L-shape, the first portion coupled with the front face and extending rearwardly from the front face and the second portion coupled with the first portion and extending downwardly from the first portion.

7. The lockout device of claim 1, further comprising:

a lock guard, including:

a receiving aperture;

a lock slot configured to receive a shank of a lock; and a shank opening;

wherein the receiving aperture is configured to receive the first end of the locking pin such that the orifice is aligned with the shank opening within the lock slot; and wherein the lock guard blocks access to the shank on at least two sides when the shank is received within the lock slot.

8. The lockout device of claim 1, wherein the second end of the locking pin includes a stop having at least one dimension larger than a corresponding dimension of the first and second apertures perpendicular to a length of the locking pin.

9. A lockout device for an item receptacle, the device comprising:

a cover including a front face configured to block an opening of the item receptacle; and an extension assembly including:

a first extension member coupled with a first link;

a second extension member coupled with a second link;

a shaft coupled with the cover; and a nut coupled with the first and second links and coupled on the shaft such that movement of the nut along an axis of the shaft extends and retracts the first and second extension members in opposite directions;

wherein the first and second extension members are configured to be inserted within the opening of the item receptacle such that the first and second extension members engage opposite inner side plates of the opening to secure the front face in place, thereby blocking the opening.

10. The lockout device of claim 9, wherein the shaft includes a thread and the nut engages the shaft such that rotation of the shaft moves the nut linearly along the axis of the shaft.

11. The lockout device of claim 10, further comprising a hasp configured to be coupled with the front face and engage a head of the shaft to block rotation thereof.

12. The lockout device of claim 10, wherein the first extension member includes a guide cylinder and a piston member, the guide cylinder coupled with a first side member of the cover, the piston member slidingly engaged within the guide cylinder and pivotably coupled with a first end of the first link, a second end of the first link pivotably coupled with the nut.

13. The lockout device of claim 12, wherein the opening is bounded by an upper plate, a lower plate, a first side plate and a second side plate and the cover includes the front face, an upper member, a lower member, a first side member, and a second side member.

14. The lockout device of claim 13, wherein the first side plate of the opening is received between the first extension member and the first side member of the cover.

15. A lockout device for an item receptacle, the device comprising:

a cover including a rectangular parallelepiped having an open rear side, the cover configured to block an opening of the item receptacle; and a locking mechanism configured to be at least partially inserted within the opening to secure the cover in place.

16. The lockout device of claim 15, wherein the rectangular parallelepiped includes a first side plate, a second side plate, front plate, an upper plate, and a lower plate, and wherein the first and second side plates each include an aperture and the locking mechanism includes a pin configured to extend through the apertures and corresponding apertures in a boundary of the opening.

17. The lockout device of claim 16, wherein a first end of the locking pin includes a shank orifice and a second end of the locking pin includes a stop configured to prevent the second end from passing through the apertures.

18. The lockout device of claim 17, wherein the locking mechanism further comprises a lock guard that blocks access to at least two sides of a lock having a shank disposed within the shank orifice.

19. The lockout device of claim 18, wherein the shank prevents removal of the lock guard when the shank is disposed within the shank orifice.

20. The lockout device of claim 15, wherein the locking mechanism includes:

a first extension member coupled with a first link;

a second extension member coupled with a second link;

a shaft coupled with the cover; and a nut coupled with the first and second links and coupled on the shaft such that movement of the nut along an axis of the shaft extends and retracts the first and second extension members in opposite directions;

wherein the first and second extension members are configured to be inserted within the opening of the item receptacle such that the first and second extension members engage opposite inner side plates of the opening to secure the cover in-place and blocking the opening.

* * * * *